US005170175A

United States Patent [19]

Kobus et al.

[11] Patent Number: 5,170,175

[45] Date of Patent: Dec. 8, 1992

[54] THIN FILM RESISTIVE LOADING FOR ANTENNAS

[75] Inventors: Joseph P. Kobus, Phoenix; Archer D. Munger, Mesa, both of Ariz.

[73] Assignee: Motorola, Inc., Schaumburg, Ill.

[21] Appl. No.: 749,236

[22] Filed: Aug. 23, 1991

[51] Int. Cl.[5] ..... H01Q 1/36

[52] U.S. Cl. ..... 343/895; 343/700 MS

[58] Field of Search ..... 343/700 MS File, 895

[56] References Cited

U.S. PATENT DOCUMENTS

| | | | |
|---|---|---|---|
| 4,636,802 | 1/1987 | Middleton | 343/895 |
| 4,658,262 | 4/1987 | Du Hamel | 343/895 |
| 4,766,444 | 8/1988 | Conroy et al. | 343/895 |
| 4,823,145 | 4/1989 | Mayes et al. | 343/895 |

*Primary Examiner*—John D. Lee
*Assistant Examiner*—Robert E. Wise
*Attorney, Agent, or Firm*—Jeffrey D. Nehr

[57] ABSTRACT

A resistively terminated antenna and method of fabricating a resistively terminated antenna comprising providing a resistor-conductor laminate, selectively removing portions of the resistive and conductive layers to produce an antenna design and mounting the resistor-conductor laminate on the dielectric substrate. Etching selectively removes portions of the conductive and resistive layers, and mounting is accomplished using a spacer, film resistor, and ground plane, where the resistor-conductor laminate is fixed to the surface of the dielectric substrate opposite the film resistor. The film resistor may have a central aperture.

41 Claims, 4 Drawing Sheets

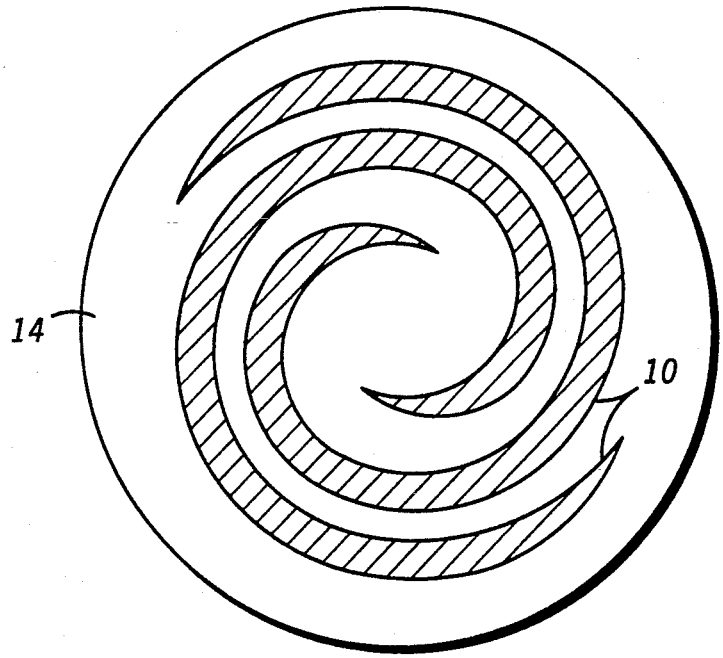
FIG. 1A
FIG. 1B
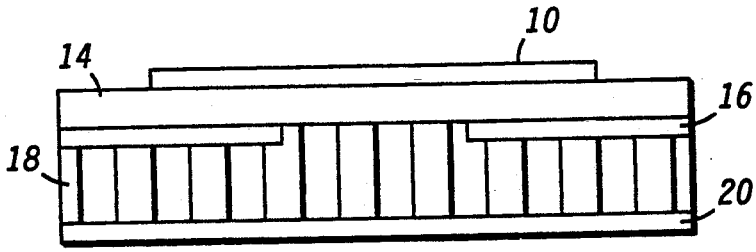

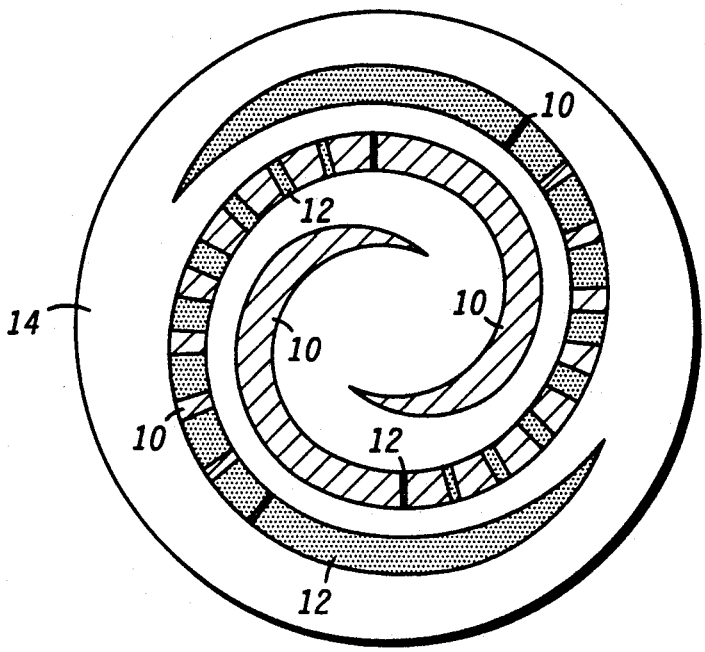
FIG. 2A
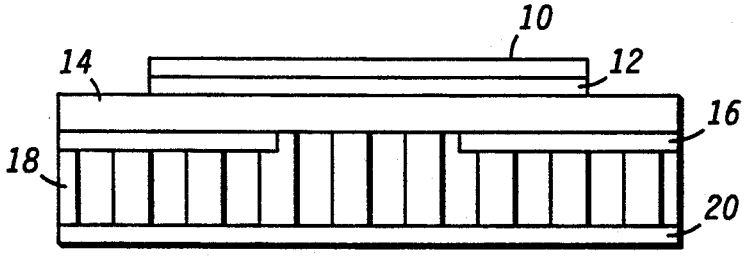
FIG. 2B
FIG. 2C
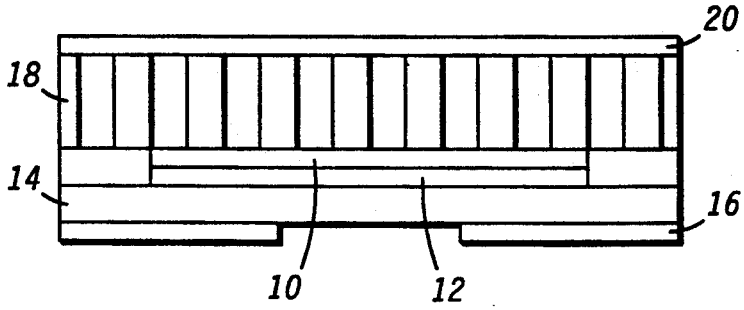

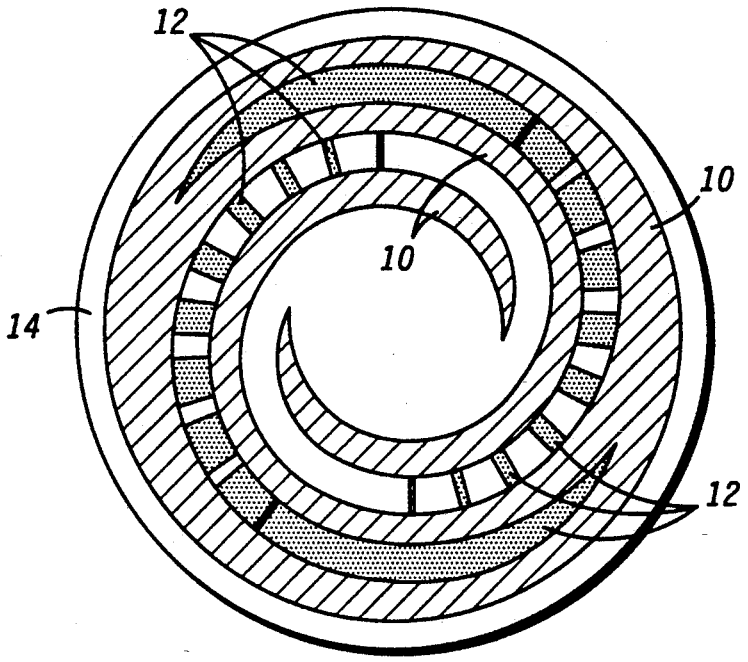
FIG. 3
FIG. 4
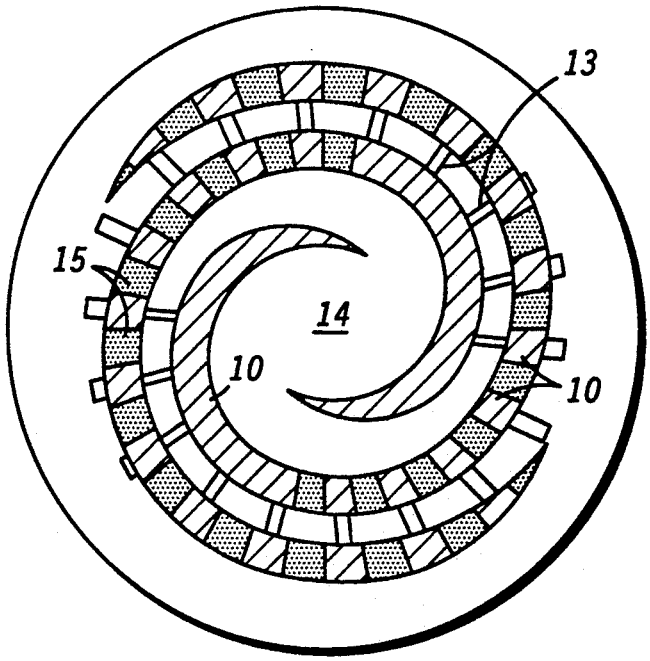

THIN FILM RESISTIVE LOADING FOR ANTENNAS

CROSS-REFERENCES TO RELATED APPLICATIONS

This invention relates to co-pending U.S. patent application Ser. No. 7-440,929 now U.S. Pat. No. 5,726,716 and related divisional U.S. patent application Ser. No. 7-640,759, both from the same inventive entity, and both having the same assignee.

BACKGROUND OF THE INVENTION

This invention relates in general to the field antennas, and in particular to thin film and printed circuit resistive loading of spiral, sinuous, or similar antennas.

Spiral and sinuous antennas are important in a number of areas, especially in direction finding, surveillance systems, and electronic countermeasure systems. In general, they are useful in low profile circular polarization applications, including communications.

Two arm planar, cavity backed spiral antenna structures with unidirectional rotationally symmetric patterns have proved to be particularly valuable. The cavity for such an antenna is typically filled with absorbing material to achieve wide bandwidths. Sinuous antennas denote antennas in the shape of curves, curves and sharp turns or bends, or straight lines and sharp turns, with the sharp turns or bends occurring in an alternating fashion (such as a "zig-zag" pattern).

Resistive termination of the arms of a spiral, sinuous, or similar antennas is necessary because any finite antenna suffers from arm-end reflections which degrade the low frequency impedance of the antenna. Resistive termination suppresses unwanted currents introduced in cavity-backed spiral, sinuous, or similar antennas.

Customary approaches for resistive termination of the arms of such antennas involve the use of resistive paint on each arm near the region of truncation, the use of lumped resistors on the end of each arm, or the use of volumetric absorbers near the end of each arm. All of these schemes require processing and/or parts additional to the printed circuit arms. In addition, volumetric or resistive paint schemes are relatively clumsy, imprecise, and often produce comparatively abrupt discontinuities in the radiation pattern of the antenna. Volumetric absorbers also require machining, installing, and bonding. Lumped resistors typically are limited to lower frequencies and are clumsy to implement. Lumped resistors also do not provide for changing value across the bandwidth of the antenna.

SUMMARY OF THE INVENTION

Accordingly, it is an advantage of the present invention to provide a new and improved method for thin film and printed circuit resistive loading of antennas. It is further an advantage to provide a resistively-loaded antenna which achieves provides good electrical bandwidth and smooth radiation patterns for the spiral, sinuous, or similar antenna produced. It is still a further advantage to provide a readily reproducible, convenient, low cost, and yet precise way to suppress unwanted currents on the arms of such antennas.

To achieve these advantages, a method of fabricating a resistively terminated antenna is contemplated which comprises the steps of providing a resistor-conductor laminate with a resistive layer immediately adjacent to a conductive layer, providing a dielectric substrate, mounting the resistor-conductor laminate on the dielectric substrate, and selectively removing portions of the conductive layer and selectively removing portions of the resistive layer to produce an antenna design on the resistor-conductor laminate.

The step of selectively removing portions of the conductive and resistive layers can be accomplished by etching. Mounting the resistor-conductor laminate on the dielectric substrate can comprise mounting a spacer to a film resistor, mounting a ground plane to the surface of the spacer opposite the film resistor, and mounting the resistor-conductor laminate to the surface of the dielectric substrate opposite the film resistor. The film resistor mounted to one surface of the sheet of uniform thickness of dielectric substrate can contain a central aperture.

The above and other features and advantages of the present invention will be better understood from the following detailed description taken in conjunction with the accompanying drawings.

BRIEF DESCRIPTION OF THE DRAWINGS

In FIG. 1A, there is shown a top view of a spiral antenna in accordance with a preferred embodiment of the invention.

In FIG. 1B, there is shown a side view of the spiral antenna of FIG. 1A.

FIG. 2A shows a top view of a spiral antenna with series resistance termination.

FIG. 2B shows a side view of the spiral antenna of FIG. 2A.

FIG. 2C shows a side view of an alternative arrangement of the layers of the antenna shown in FIGS. 2A and 2B.

FIG. 3 shows a top view of a spiral antenna with shunt series termination.

FIG. 4 illustrates a top view of a self-complementary antenna using both series and shunt resistance termination.

DETAILED DESCRIPTION OF THE PREFERRED EMBODIMENT

Figure 5:
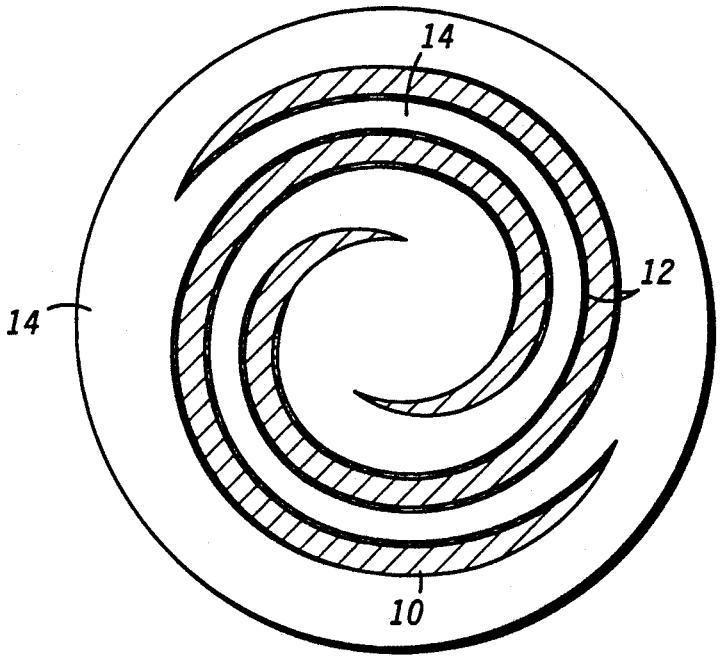
FIG. 5 shows a top view of a spiral antenna with edge resistance termination.

FIG. 1A illustrates a spiral antenna fabricated using a preferred embodiment in accordance with the invention, with conductive layer 10 mounted on a dielectric substrate 14.

FIG. 1B illustrates the side view of the spiral antenna in FIG. 1A, and shows that dielectric substrate 14, on a parallel surface opposite the surface to which conductive layer 10 is attached, is itself attached to thin film resistor sheet 16. Thin film resistive sheet 16 lies between dielectric substrate 14 and spacer 18, except to the extent that an aperture allows spacer 18 to contract dielectric substrate 14 directly. The surface of spacer 18 opposite the surface to which the thin film resistive sheet 16 is adjacent is fixed to ground plane 20.

FIG. 1B shows the thin film resistive sheet 16 physically separated from, but electrically coupled to, the antenna radiator (which is conductive layer 10). The major purpose for the thin film resistive sheet 16 is to absorb any surface-wave fields generated in the dielectric substrate 14 on which the spiral is printed. The diameter of the central aperture and the outer diameter of the thin film resistive sheet 16 can be designed for this purpose. In some instances, the design parameters may be such that an aperture diameter of zero is best. The thin film resistive sheet 16 also acts to resistively terminate the spiral arms, and may be used in combination with discrete series resistors, discrete shunt resistors, and other termination techniques discussed below. Additionally, resistivity values can be tapered (i.e., varied with distance from the center of the spiral or other pattern).

FIG. 2A displays a scheme for resistively terminating a spiral arm, in which loading is produced gradually by a number of series resistors (formed by resistive layer 12) at a number of successive gaps, beginning well before the end of a truncated arm is reached (moving outward from the center of the spiral). The resistors are physically realized by depositing an appropriate conductive-resistive laminate on a dielectric substrate 14, and then etching away as necessary the conductive layer 10 and resistive layer 12, leaving the pattern shown in FIG. 2A.

FIG. 2B illustrates the side view of the spiral antenna in FIG. 2A, and shows that resistive layer 12 is attached to dielectric substrate 14 in a layered fashion between conductive layer 10 and dielectric substrate 14. Thin film resistive sheet 16, mounted on the parallel surface of dielectric substrate 14 opposite resistive layer 12, lies layered between dielectric substrate 14 and spacer 18, except to the extent that an aperture allows spacer 18 to contract dielectric substrate 14 directly. The surface of spacer 18 opposite the surface to which the thin film resistive sheet is adjacent is fixed to ground plane 20.

FIG. 2B shows the thin film resistive sheet 16 physically separated from, but electrically coupled to, the antenna radiator (which is conductive layer 10). Again, the major purposes for the thin film resistive sheet 16 are to absorb any surface-wave fields generated in the dielectric substrate 14 on which the spiral is printed and to resistively terminate the spiral arms, and the diameter of the central aperture and the outer diameter of the thin film resistive sheet 16 can be designed for this purpose. As before, the thin film resistive sheet 16 allows for the tapering of resistivity values, and may be used in combination with discrete series resistors, discrete shunt resistors, and other termination techniques discussed below.

FIG. 2C shows an alternative arrangement of the layers in the antenna configuration represented by FIGS. 2A and 2B. In FIG. 2C, conductive layer 10, resistive layer 12, dielectric substrate 14 and thin film resistive sheet 16 are arranged as described for FIG. 2B; however, spacer 18 is mounted on the surface of conductive layer 10 opposite the parallel surface of conductive layer 10 to which resistive layer 12 is attached. In addition, ground plane 20 is mounted on the surface of spacer 18 opposite the parallel surface where spacer 18 is attached to conductive layer 10. In the FIG. 2C arrangement, the thin film resistive sheet 16 can form what is to be the out side of the antenna.

Resistive arm terminations are designed to prevent reflections when the antenna operates. As microwave energy enters the series resistive termination zone in an operating antenna, it travels from the center feed (e.g., the center of the spiral in FIG. 2A) along a conducting arm and is partially radiated, segment by segment, and gradually dissipated, resistor by resistor, until so little remains that reflections from the truncated arm are negligible.

In addition, in the application to cavity-backed spiral, sinuous, or similar antennas, the resistor pattern (i.e., the ohmic values and locations) can be tailored to help suppress unwanted currents on the arms induced by mutual coupling between the arms and their reflected images in the cavity bottom. These unwanted currents, located beyond the first radiation zone, cause undesirable distortion of radiation patterns.

FIG. 3 shows a scheme for parallel termination of the arms, in which loading is introduced gradually by successive resistors spanning the spaces between arms, beginning well before the end of a truncated arm is reached. The conductive layer 10 forms the spiral arms, and the arms are interconnected in shunt fashion by portions of resistive layer 12. Conductive layer 10 and resistive layer 12 are mounted on dielectric substrate 14. Where the antenna is to be mounted flush in a ground plane (e.g., as in FIG. 3), shunt resistors can be tapered from high resistance at the inside of the loading region to very low values at the outer edge where the antenna interfaces to the ground plane. The high shunt resistors can be discrete, tapering to lower values. Past a certain value, loading becomes continuous because the space between resistors is equal to the length of the resistors. Lower values of resistors may be obtained using wider conductive arms. Near the ground plane, a narrow gap between wide adjacent arms is continuously filled with resistive material. The taper can help prevent diffraction from the interface between the antenna and the ground plane, which can perturb the radiation patterns.

The series and shunt combination can be arranged to produce a "self-complementary" antenna. If the antenna is self-complementary, it has a constant real input impedance. It can be easily matched to a feeding structure and will have wide bandwidth. Spiral, sinuous, and similar antennas, while generally designed to be self-complementary or nearly so, have not applied the self-complementary condition to the resistive termination at the ends of the antenna arms.

The series-shunt loading concept leads to a self-complementary design of both the antenna and of the resistive terminations. An antenna can be self-complementary only if it is of infinite extent. However, in a real finite (truncated) antenna, if the loads are such that the currents are attenuated before reaching the truncation, the antenna can perform as though it were of infinite extent.

As shown in FIG. 4, the center positions of the shunt resistors 13 are equivalent to the center positions of the series resistors 15 rotated by 90 degrees (or, in general, by 180/n degrees for an n-arm antenna). The conductive and resistive layers are mounted on dielectric substrate 14. To preserve the self-complementary feature, the relationship between series and shunt resistors positioned at equal radii from the center of the antenna must satisfy:

$$\rho_{series} = \frac{Z_o^2}{4\,\rho_{shunt}} \qquad \text{Equation 1}$$

where $\rho_{series}$ is the resistance of the series resistors at radius r, $\rho_{shunt}$ is the resistance of the shunt resistors at radius r, and $Z_o$ is the impedance of free space, which is 376.6 ohms. If the base resistivity of the conductor resistor laminate is 188.3 ohms per square, the dimensions of the shunt and series resistors are equal. However, generally available base resistivity is typically not 188.3 ohms per square, and dimensions are in general different to preserve equation 1.

The advantage of the series-shunt configuration is that it allows high attenuation and yet assures that there is a matched load condition at the start of a termination. This means that currents will be highly attenuated over a short distance, and that the antenna can be truncated at a smaller radius than would be possible if a series or shunt configuration were to be used alone. The series-shunt configuration can also be tapered to a shunt only configuration for blending into the ground plane, or to a series only configuration for blending into free space.

FIG. 5 shows a scheme for loading the antenna arms in a way which is frequency dependent. FIG. 5 shows conductive layer 10, resistive layer 12, and dielectric substrate 14. In FIG. 5, the width of the resistive material for the configuration can be varied to affect the loss, which is a function of frequency (i.e., less loss for lower frequencies). For a given conductor configuration, it is known that there is more current near the edge of an arm at higher frequencies. Thus, if the edge is resistive, loss will increase with increasing frequency.

FIG. 5, with variable frequency loss, can be used to load a spiral, sinuous, or similar antenna continuously from the center feed to the outer edge. High frequency currents have little line length to traverse before reaching their radiation band and thus, higher loss per length of line can be tolerated. However, high frequency currents not radiating in the first band will be absorbed before reaching the next band. For lower frequencies, there is a long path length to the radiation band, and reduced loss per length is required to maintain antenna gain. Energy which is not radiated at the first band, however, will encounter the "load" regions at the ends of the arms. Therefore, high loss per unit length is not required at low frequencies.

A continuously loaded antenna as shown in FIG. 5 can be made self-complementary to improve radiation patterns, and lead to a theoretically real, frequency-independent input impedance if the arms are properly terminated. The self-complementary condition results from making the spaces between the arms equal to the width of the arms, and by using an equivalent resistivity of 188.3 ohms per square for the loading strips. An artificial resistance card, consisting of patterns etched out of 100 ohm per square material, can be used to achieve the 188.3 ohms per square. The artificial resistance card is described in co-pending U.S. patent application Ser. No. 7-440,929 and related divisional U.S. patent application Ser. No. 7-640,759, both from the same inventive entity, and both having the same assignee.

Note that any of the antenna designs described may be used with or without the thin film resistive sheet 16 as shown throughout FIGS. 1-5. Also, note that the antenna designs herein described are not restricted to a specific number of arms in the antenna pattern. In addition, note that lumped resistors could be used in place of the printed resistors described herein.

Preferred embodiments in accordance with the invention can embrace a large number of printed circuit terminations based on a large number of multi-arm spiral, sinuous, or similar antennas. Among these are terminations using: (1) series discrete resistors, as in FIG. 2A; (2) shunt discrete resistors, as in FIG. 3; (3) continuous series resistive arm ends of variable width, as in FIG. 2A; (4) continuous shunt resistors of variable width, where the space between arms is filled with resistive material, as in FIG. 3; (5) tapered series or shunt discrete and/or continuous resistors, as in FIGS. 2A and 3; (6) combinations of series and shunt resistors, as in FIG. 4; (7) strips of resistive material on both edges of each arm, but not touching adjacent arms, forming a continuous lossy transmission line, as in FIG. 5; and, (8) a thin film resistive sheet physically separated from, but electrically coupled to the antenna radiator, as in FIGS. 1A and 1B.

Thus, as has been described, a precision low-profile spiral, sinuous, or similar antenna can be fabricated from conductor-resistor laminates which overcomes specific problems and accomplishes certain advantages relative to prior art methods and mechanisms. The improvements are significant. An antenna so produced can be placed very close to a ground plane, if desired, because resistive loading suppresses higher-order mode and/or surface-wave radiation. Arm end terminations using the techniques described may be used in addition to the continuous loading. Radiation pattern performance and input impedance can be improved further if the antenna structure, including loading, is self-complementary and the technique described facilities fabricating such a structure. Gain at many frequencies will be higher than with conventional antennas. Reproducibility and convenience using printed circuit techniques is excellent. Good electrical bandwidth and smooth radiation patterns result from the spiral, sinuous, or similar antenna produced.

Thus, there has also been provided, in accordance with an embodiment of the invention, a resistively-loaded antenna and method for thin film and printed circuit resistive loading of antennas which overcomes specific problems and accomplishes certain advantages and which fully satisfies the aims and advantages set forth above. While the invention has been described in conjunction with a specific embodiment, many alternatives, modifications, and variations will be apparent to those of ordinary skill in the art in light of the foregoing description. Accordingly, the invention is intended to embrace all such alternatives, modifications, and variations as fall within the spirit and broad scope of the appended claims.

What is claimed is:

1. A method of fabricating a resistively terminated antenna comprising the steps of:

providing a resistor-conductor laminate with a resistive layer immediately adjacent to a conductive layer;

selectively removing portions of the conductive layer and portions of the resistive layer to produce an antenna design on the resistor-conductor laminate;

providing a dielectric substrate; and mounting the resistor-conductor laminate on the dielectric substrate.

2. A method of fabricating a resistively terminated antenna as claimed in claim 1, wherein the step of providing a resistor-conductor laminate comprises the steps of:

providing a substantially planar resistive layer of substantially uniform thickness; and providing a substantially planar conductive layer of substantially uniform thickness to produce a substantially uniform sheet of resistor-conductor laminate.

3. A method of fabricating a resistively terminated antenna as claimed in claim 1, wherein the step of selectively removing portions of the conductive layer and portions of the resistive layer to produce an antenna design comprise the step of etching.

4. A method of fabricating a resistively terminated antenna as claimed in claim 3, wherein the step of selectively removing portions of the conductive layer and portions of the resistive layer to produce an antenna design further comprises the step of shaping the antenna design into a pattern of conductive spiral arms to form the radiative portion of the antenna.

5. A method of fabricating a resistively terminated antenna as claimed in claim 4, wherein the step of shaping the antenna design into a pattern of conductive spiral arms comprises the steps of:

etching a series of resistive areas to interrupt conductive areas along the lengths of the spiral arms; and etching successive resistive area lengths along the spiral arms to increase from the center of the spiral, terminating in resistive spiral ends.

6. A method of fabricating a resistively terminated antenna as claimed in claim 4, wherein the step of shaping the antenna design into a pattern of conductive spiral arms comprises the steps of:

etching resistive areas between conductive spiral arms; and etching increasing successive resistive area widths along the spiral arms from the center of the spiral, where the conductive spiral arms merge at the outermost extent of the conductive spiral arms from the center of the spiral.

7. A method of fabricating a resistively terminated antenna as claimed in claim 4, wherein the step of shaping the antenna design into a pattern of conductive spiral arms comprises the steps of:

etching a series of resistive areas to interrupt conductive areas along the lengths of the spiral arms; and etching successive resistive area lengths along the spiral arms to increase from the center of the spiral, terminating in resistive spiral ends;

etching resistive areas between conductive spiral arms; and etching increasing successive resistive area widths along the spiral arms from the center of the spiral, to form a self-complementary antenna configuration.

8. A method of fabricating a resistively terminated antenna as claimed in claim 4, wherein the step of shaping the antenna design into a pattern of conductive spiral arms comprises the step of etching strips of resistive material on both edges of each spiral arm, but not touching adjacent spiral arms, to form a continuous lossy transmission line.

9. A method of fabricating a resistively terminated antenna as claimed in claim 3, wherein the step of providing a dielectric substrate comprises the steps of:

providing a sheet of uniform thickness of dielectric substrate; and mounting a film resistor to one surface of the sheet of uniform thickness of dielectric substrate.

10. A method of fabricating a resistively terminated antenna as claimed in claim 9, wherein, the step of mounting the resistor-conductor laminate on the dielectric substrate comprises:

mounting a spacer to the film resistor;

mounting a ground plane to the surface of the spacer opposite the film resistor; and mounting the resistor-conductor laminate to the surface of the dielectric substrate opposite the film resistor.

11. A method of fabricating a resistively terminated antenna as claimed in claim 9, wherein, the step of mounting the resistor-conductor laminate on the dielectric substrate comprises:

mounting a spacer to the resistor-conductor laminate;

mounting a ground plane to the surface of the spacer opposite the resistor-conductor laminate; and mounting the resistor-conductor laminate to the surface of the dielectric substrate opposite the film resistor.

12. A method of fabricating a resistively terminated antenna as claimed in claim 9, wherein the step of mounting a film resistor to one surface of the sheet of uniform thickness of dielectric substrate comprises the step of mounting a film resistor with a central aperture.

13. A method of fabricating a resistively terminated antenna as claimed in claim 9, wherein the step of mounting the resistor-conductor laminate on the dielectric substrate comprises the step of mounting the resistor-conductor surface on the dielectric substrate surface opposite the film resistor.

14. A method of fabricating a resistively terminated antenna as claimed in claim 1, wherein the step of selectively removing portions of the conductive layer and portions of the resistive layer to produce an antenna design further comprise the step of shaping the antenna design into a sinuous configuration.

15. A method of fabricating a cavity-backed antenna which is resistively terminated, the method comprising the steps of:

laminating a resistive layer to a conductive layer;

selectively removing portions of the conductive layer and portions of the resistive layer to produce an antenna design; and mounting the resistive layer and conductive layer on a dielectric substrate.

16. A method of fabricating a cavity-backed antenna as claimed in claim 15, wherein the step of laminating a resistive layer to a conductive layer comprises the steps of:

providing a substantially planar resistive layer of substantially uniform thickness; and providing a substantially planar conductive layer of substantially uniform thickness.

17. A method of fabricating a cavity-backed antenna as claimed in claim 15, wherein the step of selectively removing portions of the conductive layer and portions of the resistive layer to produce an antenna design comprises the step of etching.

18. A method of fabricating a cavity-backed antenna as claimed in claim 17, wherein the step of selectively removing portions of the conductive layer and portions of the resistive layer to produce an antenna design further comprises the step of shaping the antenna design into a sinuous configuration.

19. A method of fabricating a cavity-backed antenna as claimed in claim 17, wherein the step of selectively removing portions of the conductive layer and portions of the resistive layer to produce an antenna design further comprises the step of shaping the antenna design into a pattern of conductive spiral arms.

20. A method of fabricating a cavity-backed antenna as claimed in claim 19, wherein the step of shaping the antenna design into a pattern of conductive spiral arms comprises the steps of:

etching a series of resistive areas to interrupt conductive areas along the lengths of the spiral arms; and etching successive resistive area lengths along the spiral arms to increase from the center of the spiral, terminating in resistive spiral ends.

21. A method of fabricating a cavity-backed antenna as claimed in claim 19, wherein the step of shaping the antenna design into a pattern of conductive spiral arms comprises the steps of:

etching resistive areas between conductive spiral arms; and etching increasing successive resistive area widths along the spiral arms from the center of the spiral, where the conductive spiral arms merge at the outermost extent of the conductive spiral arms from the center of the spiral.

22. A method of fabricating a cavity-backed antenna as claimed in claim 19, wherein the step of shaping the antenna design into a pattern of conductive spiral arms comprises the step of etching strips of resistive material on both edges of each spiral arm, but not touching adjacent spiral arms, to form a continuous lossy transmission line.

23. A method of fabricating a cavity-backed antenna as claimed in claim 17, wherein the step of mounting the resistive layer and the conductive layer on a dielectric substrate comprises the steps of:

providing a sheet of uniform thickness of dielectric substrate; and mounting a film resistor to one surface of the sheet of uniform thickness of dielectric substrate.

24. A method of fabricating a cavity-backed antenna as claimed in claim 23, wherein, the step of mounting the resistive layer and the conductive layer on a dielectric substrate further comprises:

mounting a spacer to the film resistor;

mounting a ground plane to the surface of the spacer opposite the film resistor; and mounting the resistive layer and the conductive layer to the surface of the dielectric substrate opposite the film resistor.

25. A method of fabricating a cavity-backed antenna as claimed in claim 23, wherein, the step of mounting the resistive layer and the conductive layer on a dielectric substrate further comprises:

mounting a spacer to the conductive layer;

mounting a ground plane to the surface of the spacer opposite the conductive layer; and mounting the surface of the dielectric substrate opposite the film resistor to the resistive layer.

26. A method of fabricating a cavity-backed antenna as claimed in claim 23, wherein the step of mounting a film resistor to one surface of the sheet of uniform thickness of dielectric substrate comprises the step of mounting a film resistor with a central aperture.

27. A method of fabricating a cavity-backed antenna as claimed in claim 23, wherein the step of mounting the layer and the conductive layer on the dielectric substrate comprises the step of mounting the resistive surface on the dielectric substrate surface opposite the film resistor.

28. A resistively terminated antenna, comprising:

conducting means with first and second parallel opposite surfaces;

resistive means with first and second parallel opposite surfaces, where the second surface of the conducting means is immediately adjacent to the first surface of the resistive means;

dielectric means with first and second parallel opposite surfaces, where the second surface of the resistive means is immediately adjacent to the first surface of the dielectric means;

film resistor means with first and second parallel opposite surfaces, where the second surface of the dielectric means is immediately adjacent to the first surface of the film resistor means;

spacer means with first and second parallel surfaces, where the second surface of the film resistor means is immediately adjacent to the first surface of the spacer means; and ground plane means with first and second parallel surfaces, where the second surface of the spacer means is immediately adjacent to the first surface of the ground plane means.

29. A resistively terminated antenna as claimed in claim 28, wherein the conducting means is shaped into a sinuous configuration antenna design.

30. A resistively terminated antenna as claimed in claim 28, wherein the conducting means is shaped into a pattern of conductive spiral arms to form the radiative portion of the antenna.

31. A resistively terminated antenna as claimed in claim 30, wherein the pattern of conductive spiral arms comprises:

a series of resistive areas interrupting conductive areas along the lengths of the spiral arms, the resistive areas of increasing length along the spiral arms increasing from the center of the spiral; and the spiral arms terminating in resistive spiral ends.

32. A resistively terminated antenna as claimed in claim 30, wherein the pattern of conductive spiral arms comprises:

a series of resistive areas between conductive spiral arms, the resistive areas of increasing width along the spiral arms increasing from the center of the spiral; and the spiral arms merging at the outermost extent of the spiral.

33. A resistively terminated antenna as claimed in claim 30, wherein the pattern of conductive spiral arms comprises strips of resistive material on both edges of each spiral arm, not touching adjacent spiral arms, to form a continuous lossy transmission line.

34. A resistively terminated antenna as claimed in claim 28, wherein the film resistor means has a central aperture.

35. A resistively terminated antenna, comprising:

conducting means with first and second parallel opposite surfaces;

resistive means with first and second parallel opposite surfaces, where the second surface of the conducting means is immediately adjacent to the first surface of the resistive means;

dielectric means with first and second parallel opposite surfaces, where the second surface of the resistive means is immediately adjacent to the first surface of the dielectric means;

film resistor means with first and second parallel opposite surfaces, where the second surface of the dielectric means is immediately adjacent to the first surface of the film resistor means;

spacer means with first and second parallel surfaces, where the first surface of the conducting means is immediately adjacent to the second surface of the spacer means; and ground plane means with first and second parallel surfaces, where the second surface of the ground plane means is immediately adjacent to the first surface of the spacer means.

36. A resistively terminated antenna as claimed in claim 35, wherein the conducting means is shaped into a sinuous configuration antenna design.

37. A resistively terminated antenna as claimed in claim 35, wherein the conductive means is shaped into a pattern of conductive spiral arms to form the radiative portion of the antenna.

38. A resistively terminated antenna as claimed in claim 37, wherein the pattern of conductive spiral arms comprises:

a series of resistive areas interrupting conductive areas along the lengths of the spiral arms, the resistive areas of increasing length along the spiral arms increasing from the center of the spiral; and the spiral arms terminating in resistive spiral ends.

39. A resistively terminated antenna as claimed in claim 35, wherein the film resistor means has a central aperture.

40. A resistively terminated antenna as claimed in claim 39, wherein the pattern of conductive spiral arms comprises:

a series of resistive areas between conductive spiral arms, the resistive areas of increasing width along the spiral arms increasing from the center of the spiral; and the spiral arms merging at the outermost extent of the spiral.

41. A resistively terminated antenna as claimed in claim 39, wherein the pattern of conductive spiral arms comprises strips of resistive material on both edges of each spiral arm, not touching adjacent spiral arms, to form a continuos lossy transmission line.

* * * * *